United States Patent [19]

Taylor, Sr.

[11] 4,379,518

[45] Apr. 12, 1983

[54] THREE CELL DIVIDER FOR CARTON

[75] Inventor: Edwin C. Taylor, Sr., Toledo, Ohio

[73] Assignee: Owens-Illinois, Inc., Toledo, Ohio

[21] Appl. No.: 293,824

[22] Filed: Aug. 17, 1981

[51] Int. Cl.[3] ..... B65D 5/48

[52] U.S. Cl. ..... 229/15; 229/27; 229/28 R

[58] Field of Search ..... 229/15, 27, 28 R

[56] References Cited

U.S. PATENT DOCUMENTS

| | | | |
|---|---|---|---|
| 1,131,773 | 3/1915 | Davidson | 229/15 |
| 3,702,170 | 11/1972 | Adams | 229/15 |
| 3,958,745 | 5/1976 | Lindsay | 229/27 |
| 4,124,158 | 11/1978 | Beck | 229/28 R |
| 4,143,804 | 3/1979 | Visnyd as | 229/15 |
| 4,227,641 | 10/1980 | Gardner | 229/15 |

FOREIGN PATENT DOCUMENTS

| | | | |
|---|---|---|---|
| 1268538 | 5/1968 | Fed. Rep. of Germany | 229/15 |
| 1486597 | 6/1969 | Fed. Rep. of Germany | 229/15 |
| 559660 | 2/1944 | United Kingdom | 229/28 R |
| 871498 | 6/1961 | United Kingdom | 229/15 |

*Primary Examiner*—Herbert F. Ross

*Attorney, Agent, or Firm*—John R. Nelson; Myron E. Click; David H. Wilson

[57] ABSTRACT

The disclosure relates to a three cell divider for a rectangular corrugated box which may be fabricated from a single sheet of corrugated board by cutting and scoring operations thereon, and then erected for insertion in the box. The divider comprises a horizontal bottom portion having two panel portions integrally secured to opposite sides and opposite ends of the bottom portion and respectively foldable into an upright, horizontally U-shaped configuration, thus defining two divider walls and four walls abutting the box walls. Projecting tabs on the free ends of two of the abutting walls engage notches in opposed corners of the horizontal bottom portion to maintain the divider in its erected position.

4 Claims, 3 Drawing Figures

THREE CELL DIVIDER FOR CARTON

BACKGROUND OF THE INVENTION

The invention relates to a divider for cartons, more specifically to a three cell divider which can be produced from a single sheet of corrugated board by scoring and cutting operations.

Recent innovations in the marketing of a large number of products have been in the direction of providing multi-unit packages of such products. It is, of course, desirable that the multi-unit packaging be effected within the confines of a corrugated shipping box. The customary corrugated partition is a relatively expensive item to fabricate and assemble, because it requires a stamping operation to cut out the notches and a special machine to assemble a plurality of transversely disposed partitions with respect to a plurality of longitudinally disposed partitions. Moreover, the number of product cells produced by a conventional partition is always an even number and four cells is the absolute minimum that can be produced.

There is, therefore, a definitive need for a partition or dividing structure which will conveniently effect the dividing of the interior of a corrugated box into three cells and, at the same time, provide substantial reinforcement of the box insofar as vertical load carrying capabilities are concerned. While not limited thereto, a divider embodying this invention finds particular utility in the transporting of three large size soft drink containers having a capacity on the order of 48 ounces to 64 ounces each. In such application, the divider also provides separation of the containers and prevents sidewall damage due to contact with each other.

SUMMARY OF THE INVENTION

This invention provides a unique three cell divider for insertion into a rectangularly-shaped carton to effect the division of the interior of the carton into three independent cells so that product inserted in such cells will be adequately protected from top loading while being transported in the carton.

A single sheet of corrugated board is cut and creased so as to define a generally horizontal bottom portion which is shaped to be snugly insertable into the carton in overlying relationship to the bottom of the carton. A large flap is then partially cut from each elongated side wall of the bottom portion and each flap is creased so as to be foldable into an upright configuration which is U-shaped in a horizontal plane. The bight portion of each U-shaped vertical configuration extends transversely between opposed side walls of the carton, while the arm portions of each U-shaped configuration are in abutment with such side walls. The two vertical bight portions are respectively horizontally spaced from the end walls of the carton and from each other to divide the interior of the carton into three cells for the reception of three or more containers or products.

To further secure the two U-shaped divider panels in their upright position, a notch is cut out of the diagonally opposed ends of the horizontal bottom portion of the divider, and a corresponding tab is formed on the bottom of one of the unsecured arm portions of each U-shaped divider to cooperate with such notch to retain such arm portion in its proper position in the carton.

DESCRIPTION OF THE PREFERRED EMBODIMENT

Figure 1:
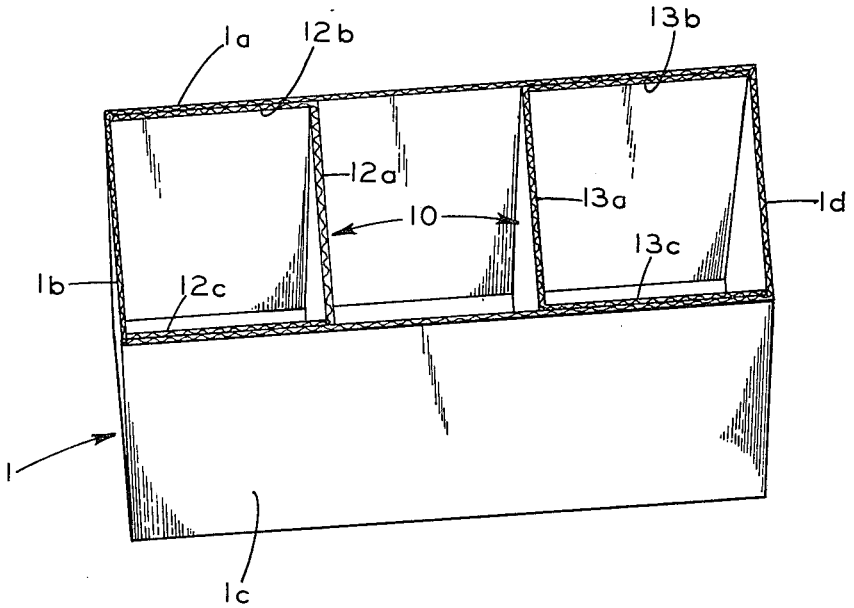
FIG. 1 is a perspective view showing a three cell divider constructed in accordance with this invention and assembled in a rectangular carton.
Figure 2:
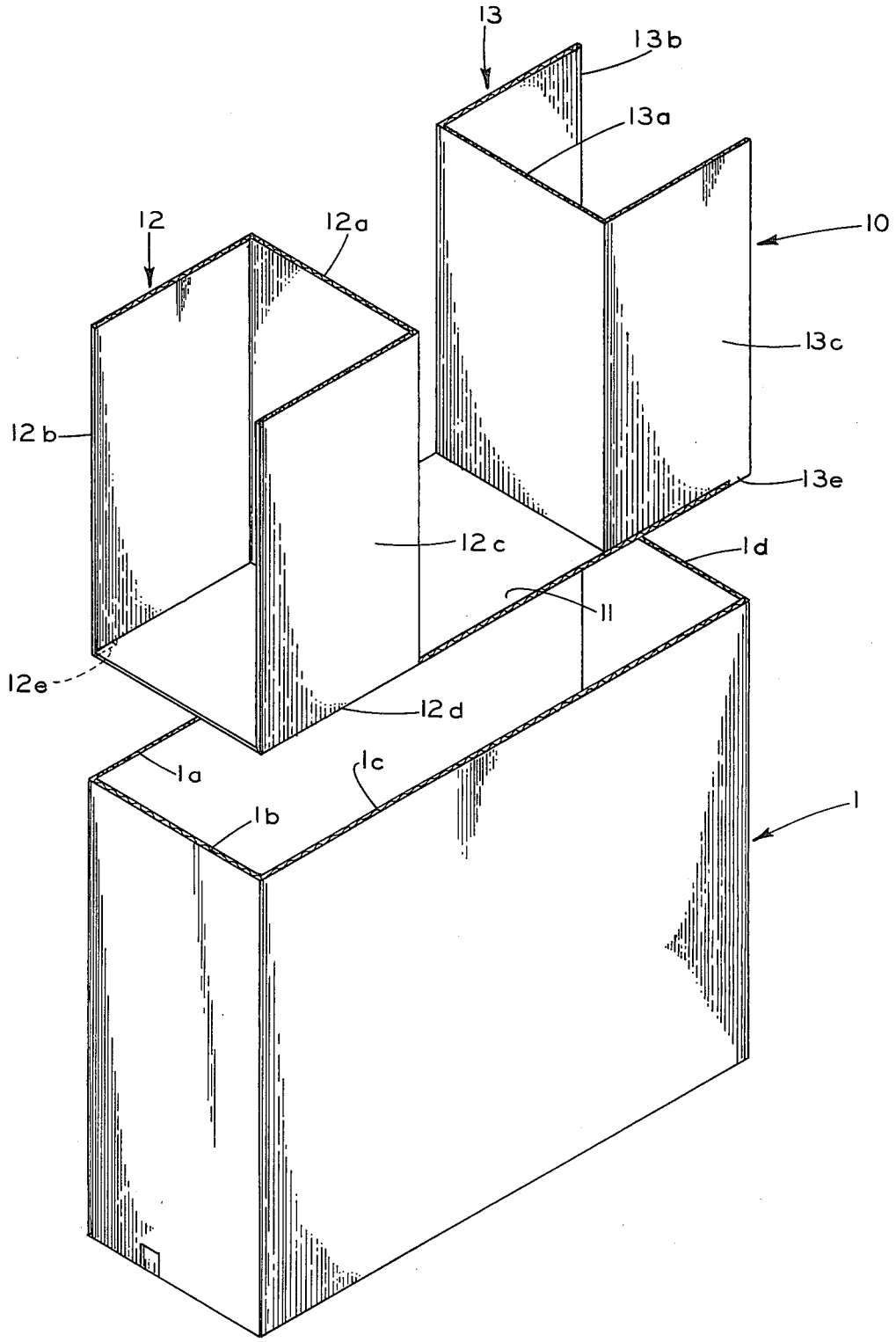
FIG. 2 is an exploded view of the carton of FIG. 1, with the three cell divider shown in erected position prior to insertion in the carton.

Referring to FIGS. 1 and 2, the three cell divider 10 embodying this invention is designed for assemblage into a conventional rectangularly-shaped carton 1 having side walls 1*a*, 1*b*, 1*c* and 1*d*. The three cell divider 10 is formed from a single sheet 20 (FIG. 3) of corrugated material in a manner to be hereinafter described.

The three cell divider 10 includes a generally horizontal base portion 11 and two upstanding generally U-shaped vertical divider portions 12 and 13. Each U-shaped divider portion comprises a bight portion 12*a* and 13*a* which span the space between the opposed side walls 1*a* and 1*c* of the box 1 and are respectively located at spaced distances from each other and the end walls 1*b* and 1*d* of the box which may be equal or may differ. All of the vertical arm portions 12*b*, 12*c* and 13*b*, 13*c* of the two U-shaped dividers 12 and 13 are disposed in abutting relationship with one or the other of the opposed side walls 1*a* and 1*c* of the box 1. Only one of such arm portions of each divider is foldably secured to the bottom portion 11. In the example illustrated in the drawings, the bottom end of arm portion 12*c* and the bottom end of arm portion 13*b* are respectively foldably secured by fold lines 12*d* and 13*d* (FIG. 3) to the opposite ends of the edges 11*a* and 11*b* of the horizontal bottom portion 11 of the three cell divider 10.

Since the U-shaped cell dividers 12 and 13 are only integrally attached to the bottom wall portion 11 by the fold lines 12*d* and 13*d*, it may be desirable to provide an interlocking of the unsecured wall portions of the divider 10. This may be conveniently accomplished by cutting rectangular notches 11*c* and 11*d* in the diagonally opposed corners of the bottom wall 11 and having such notches engaged by downwardly extending projections or tabs 12*e* and 13*e* respectively provided on divider cell walls 12*b* and 13*c*.

Figure 3:
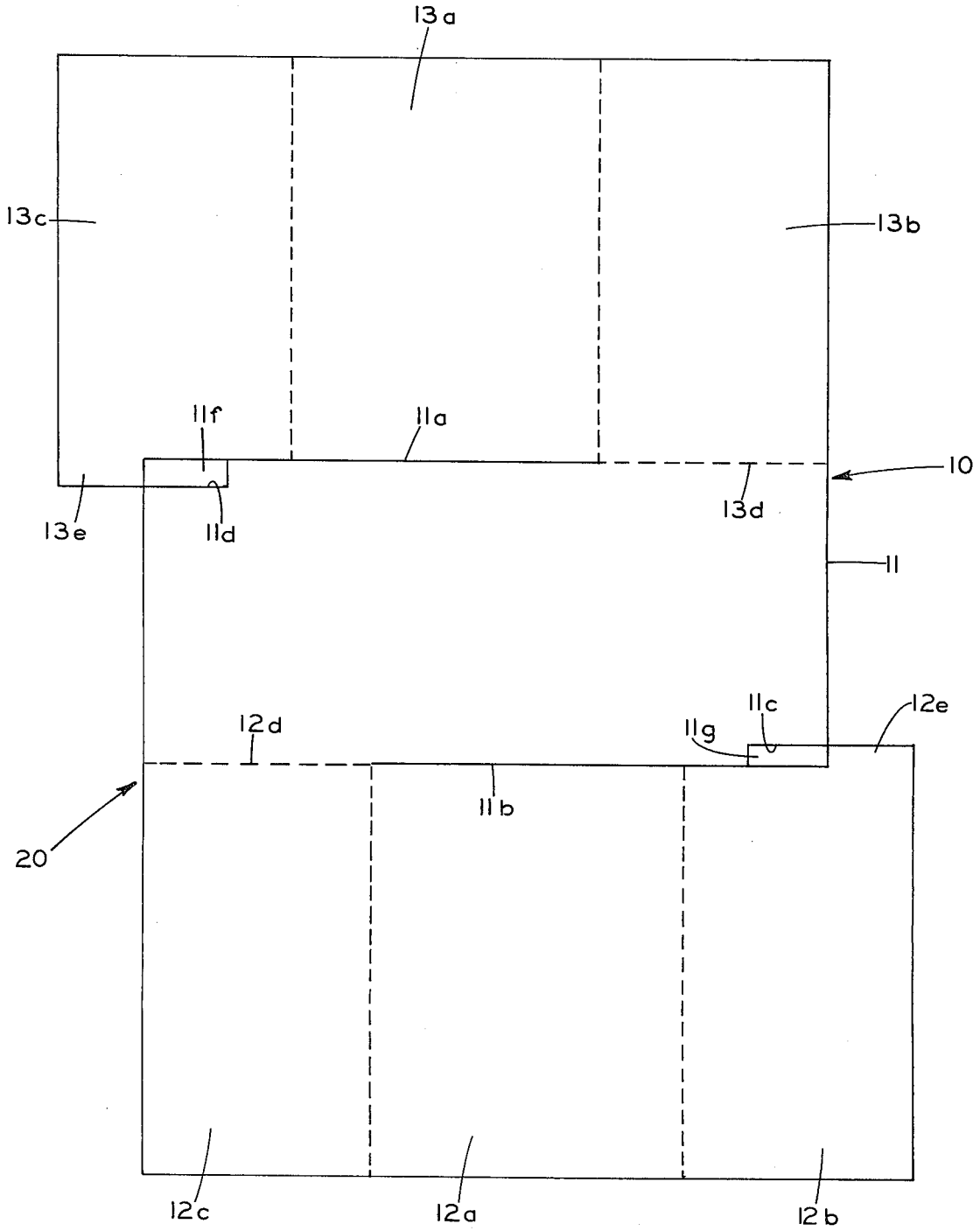
FIG. 3 is a plan view of the blank from which the three cell divider of FIGS. 1 and 2 is fabricated.

Referring to FIG. 3, the fabrication of the aforedescribed three cell divider will be readily apparent. The fold lines provided on the blank are indicated by dotted lines and result in the formation of the bottom panel 11, and three panels 12*a*, 12*b*, and 12*c* of the one vertical divider 12 and panels 13*a*, 13*b* and 13*c* of the other divider 13. The integral fold lines 12*d* and 13*d* are also defined by the dotted lines. The notches 11*c* and 11*d* in the bottom wall 11 and the projections 12*e* and 13*e* are respectively defined by cut out portions 11*g* and 11*f* formed in the opposed corners of the bottom portion 11.

Modifications of this invention will be readily apparent to those skilled in the art and it is intended that the scope of the invention be determined solely by the appeneded claims.

What is claimed is:

1. A three cell corrugated divider for insertion in an open top of a rectangular box comprising a single blank folded to define:

(1) a horizontal bottom portion insertable in the box and conforming to the bottom of the box;

(2) a first horizontally U-shaped vertical divider having the vertical bight portion adapted to traverse the space between opposed side walls of the box and two vertical arm portions respectively adapted to abut opposed end areas of said opposed side walls, only one of said vertical arm portions being foldably secured to a portion of one edge of said horizontal bottom portion, and (3) a second horizontally U-shaped vertical divider having a vertical bight portion adapted to traverse the space between said opposed side walls of the box in horizontally spaced relation to the bight portion of said first vertical divider and two vertical wall portions respectively adapted to abut the other opposed end areas of said opposed side walls of the box, only one of said vertical wall portions of said second vertical divider being foldably secured to a portion of the other edge of said horizontal base portion.

2. The divider of claim 1 wherein the diagonally opposed end portions of said edges of the horizontal base that are not foldably secured to said vertical arm portions are notched, and tabs are formed on the bottom of each of the other of said vertical arm portions to respectively engage said notches.

3. A corrugated blank for erection as a three cell divider for a rectangular carton comprising: a rectangular center portion constructed and arranged to lie in the bottom of the carton in conforming relation to the carton bottom, a first flap foldably secured to an end portion of one longitudinal edge of said center portion for a minor portion of the length of said first flap, thereby permitting folding of said first flap into a vertical position relative to said center portion, a pair of longitudinally spaced, parallel score lines traversing said first flap, said score lines being spaced apart by a distance equal to the width of the carton, permitting folding of said first flap portion into a U-shaped configuration in a horizontal plane with the arm portions of the "U" respectively abutting the opposite longitudinal walls of the carton and the base of the "U" dividing the interior of the carton; and a second flap foldably secured along a minor portion of its length to an end portion of the other longitudinal edge of said center portion in diagonally opposed relation to said first flap, thereby permitting folding of said second flap into a vertical position relative to said center portion, a pair of longitudinally spaced, parallel score lines traversing said second flap portion, said score lines being spaced apart by a distance equal to the width of the carton, permitting folding of said second flap portion into a U-shaped configuration in a horizontal plane with the arms of the "U" respectively abutting the opposite longitudinal walls of the carton and the base of the "U" dividing the interior of the carton.

4. The corrugated blank of claim 3 plus a tab formed on each flap portion respectively lying adjacent to the diagonally opposed latitudinal edges of said center portion, and a recess cut into the diagonally opposed corners of said center portion adjacent said tabs to respectively receive said tabs when said flap portions are erected and folded into U-shaped configuration.

* * * * *